US007247083B2

(12) United States Patent
Miyashita et al.

(10) Patent No.: US 7,247,083 B2
(45) Date of Patent: Jul. 24, 2007

(54) POLISHING APPARATUS

(75) Inventors: Tadakazu Miyashita, Nagano (JP); Hiromi Kishida, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 142 days.

(21) Appl. No.: 11/088,191

(22) Filed: Mar. 23, 2005

(65) Prior Publication Data

US 2005/0221733 A1 Oct. 6, 2005

(30) Foreign Application Priority Data

Mar. 31, 2004 (JP) ..... 2004-104580
Mar. 2, 2005 (JP) ..... 2005-056813

(51) Int. Cl.
*B24B 1/00* (2006.01)

(52) U.S. Cl. ..... 451/285; 451/288; 451/289; 451/398; 451/443

(58) Field of Classification Search ..... 451/41, 451/56, 285, 287, 288, 289, 388, 397, 398, 451/443
See application file for complete search history.

(56) References Cited

U.S. PATENT DOCUMENTS 5,584,751 A 12/1996 Kobayashi et al.
5,885,140 A * 3/1999 Hakomori ..... 451/72
6,135,858 A * 10/2000 Takahashi ..... 451/41
2001/0000775 A1 5/2001 Zuniga et al.
2001/0053665 A1* 12/2001 Lee et al. ..... 451/288
2002/0182996 A1* 12/2002 Zuniga et al. ..... 451/401
2003/0139123 A1* 7/2003 Somekh ..... 451/289
2005/0020185 A1* 1/2005 Zuniga et al. ..... 451/5
2005/0037698 A1* 2/2005 Zuniga et al. ..... 451/287
2005/0153635 A1* 7/2005 Boo et al. ..... 451/285
2006/0099892 A1* 5/2006 Togawa et al. ..... 451/285
2006/0128277 A1* 6/2006 Maloney et al. ..... 451/41
2006/0199479 A1* 9/2006 Togawa et al. ..... 451/59

FOREIGN PATENT DOCUMENTS

EP 0 841 123 5/1998
EP 1 029 633 8/2000
JP 3158934 2/2001

* cited by examiner

*Primary Examiner*—Eileen P. Morgan
(74) *Attorney, Agent, or Firm*—Jordan and Hamburg LLP

(57) ABSTRACT

The polishing apparatus is capable of precisely controlling polishing pressure, correctly positioning a press plate and uniformly polishing a workpiece. In the polishing apparatus, a holding head comprises: first pressing means for introducing a pressurized fluid into a first fluid chamber and pressing a main head section downward; second pressing means for introducing a pressurized fluid into a second fluid chamber and pressing a press plate downward; and third pressing means for introducing a pressurized fluid into a third fluid chamber and pressing the workpiece downward. With this structure, the workpiece is held on the lower side of an elastic sheet member, and the lower face of the workpiece can be polished by a polishing plate.

16 Claims, 4 Drawing Sheets

POLISHING APPARATUS

BACKGROUND OF THE INVENTION

The present invention relates to a polishing apparatus capable of uniformly polish workpieces, e.g., wafers.

Many kinds of polishing apparatuses are known.

Generally, a polishing apparatus comprises: a polishing plate having an upper face, on which a polishing cloth is adhered; a holding head having a lower face, on which a workpiece is held so as to press the workpiece onto the polishing cloth; and a driving mechanism for relatively moving the polishing plate with respect to the holding head so as to polish a lower face of the workpiece.

A conventional polishing apparatus is disclosed in Japanese Patent No. 3158934. The polishing apparatus includes a holding head comprising: a main head section; a carrier provided in the main head section, the carrier holding a workpiece to be polished; a retainer ring provided outside of the carrier and coaxially arranged therewith, the retainer ring contacting the polishing cloth and holding an outer edge of the workpiece; a carrier pressure adjusting mechanism adjustably pressing the carrier toward a platen; and a ring pressure adjusting mechanism separated from the carrier pressure adjusting mechanism, the ring pressure adjusting mechanism adjustably pressing the retainer ring toward the platen.

In the polishing apparatus, the ring pressure adjusting mechanism is separated from the carrier pressure adjusting mechanism. Therefore, waving of the polishing close, which occurs near the workpiece, can be effectively prevented, so that overpolishing an outer edge of the workpiece can be effectively prevented.

These days, however, precise control of polishing pressure is required so as to further precisely polish the workpiece.

SUMMARY OF THE INVENTION

The present invention has been invented to solve the problem of the conventional polishing apparatus.

An object of the present invention is to provide a polishing apparatus, which is capable of precisely controlling polishing pressure, correctly positioning a press plate (a carrier) and uniformly polishing a workpiece.

To achieve the object, the present invention has following structures.

A first basic structure of the polishing apparatus of the present invention comprises:

a polishing plate having an upper face, on which a polishing cloth is adhered;

a holding head having a lower face, on which a workpiece is held so as to press the workpiece onto the polishing cloth; and a driving mechanism for relatively moving the polishing plate with respect to the holding head so as to polish a lower face of the workpiece, and the holding head comprises:

a head base;

a main head section being attached on the lower side of the head base with a first diaphragm and capable of moving toward the polishing plate, the main head section having a press ring, which is provided on the lower side thereof and capable of pressing the polishing cloth;

a press plate being provided in the main head section with a second diaphragm and capable of moving toward the polishing plate;

an elastic sheet member being attached on a lower face of the press plate;

a first fluid chamber being formed between the head base and the main head section and closed by the first diaphragm;

a second fluid chamber being formed between the main head section and the press plate and closed by the second diaphragm;

a third fluid chamber being formed between the lower face of the press plate and the elastic sheet member;

first pressing means for introducing a pressurized fluid into the first fluid chamber and pressing the main head section downward;

second pressing means for introducing a pressurized fluid into the second fluid chamber and pressing the press plate downward; and third pressing means for introducing a pressurized fluid into the third fluid chamber and pressing the workpiece downward, whereby the workpiece is held on the lower side of the elastic sheet member, and the lower face of the workpiece can be polished.

In the polishing apparatus, the third pressing means may discharge the fluid in the third fluid chamber so as to give a sucking function to the elastic sheet member so that the elastic sheet member is capable of sucking and holding the workpiece.

In the polishing apparatus, a backing pad may be adhered on a lower face of the elastic sheet member, and the workpiece may be held on the lower side of the backing pad.

A second basic structure of the polishing apparatus of the present invention comprises:

a polishing plate having an upper face, on which a polishing cloth is adhered;

a holding head having a lower face, on which a workpiece is held so as to press the workpiece onto the polishing cloth; and a driving mechanism for relatively moving the polishing plate with respect to the holding head so as to polish a lower face of the workpiece, and the holding head comprises:

a head base;

a main head section being attached on the lower side of the head base with a first diaphragm and capable of moving toward the polishing plate, the main head section having a press ring, which is provided on the lower side thereof and capable of pressing the polishing cloth;

a press plate being provided in the main head section with a second diaphragm and capable of moving toward the polishing plate;

a first fluid chamber being formed between the head base and the main head section and closed by the first diaphragm;

a second fluid chamber being formed between the main head section and the press plate and closed by the second diaphragm;

a third fluid chamber being formed in the press plate, the third fluid chamber being communicated to outside of a lower face of the press plate via a plurality of holes;

first pressing means for introducing a pressurized fluid into the first fluid chamber and pressing the main head section downward;

second pressing means for introducing a pressurized fluid into the second fluid chamber and pressing the press plate downward; and third pressing means for introducing a pressurized fluid into the third fluid chamber and pressing the workpiece downward, and whereby the workpiece is held on the lower side of the press plate and polished.

In the polishing apparatus, a backing pad having a plurality of fine holes may be attached to the lower face of the press plate.

In the polishing apparatus, the third pressing means may discharge the fluid in the third fluid chamber so as to suck and hold the workpiece on the lower side of the press plate.

In the polishing apparatus, the main head section may have a cylindrical shape and is vertically divided into an upper cylindrical part and a lower cylindrical part by a partition; the first fluid chamber may be constituted by the head base entering the upper cylindrical part and the first diaphragm closing a space between the head base and the upper cylindrical part; and the second fluid chamber may be constituted by the press ring attached to the lower cylindrical part, the press plate provided in the lower cylindrical part and the second diaphragm closing a space between the lower cylindrical part and the press plate.

In the polishing apparatus, a rotary shaft may be connected to the head base; the head base may be rotated by rotating the rotary shaft; the main head section may be rotated with the first diaphragm; and the press plate may be rotated with the second diaphragm.

In each of the apparatuses, a rotary shaft may be connected to the head base; the head base and the main head section may be engaged by a first transmitting member so as to allow the main head section to move upward and downward; the main head section and the press plate may be engaged by a second transmitting member so as to allow the press plate to move upward and downward; the head base may be rotated by rotating the rotary shaft; the main head section may be rotated with the first transmitting member; and the press plate may be rotated with the second transmitting member.

In each of the apparatuses, the first transmitting member and the second transmitting member may be pins.

In each of the apparatuses, a center shaft may be vertically extended from a center of the press plate, and the center shaft may be capable of fitting with a shaft hole of the head base, so that the press plate can be correctly positioned and transverse vibrations of the press plate can be prevented.

In each of the apparatuses, a fluid path communicating with the third fluid chamber may be formed in the center shaft, and a pressurized fluid may be introduced into the third fluid chamber via the fluid path.

In each of the apparatuses, the head base and the main head section may respectively have engaging parts, which engage each other when the head base is moved upward, and the engaging parts may be slope faces, which are capable of correctly positioning the main head section with respect to the head base.

In each of the apparatuses, the main head section and the press plate may respectively have engaging parts, which engage each other when the head base is moved upward, and the engaging parts may be slope faces, which are capable of correctly positioning the press plate with respect to the main head section.

In each of the apparatuses, the press ring may include: a guide ring enclosing the workpiece so as to prevent the workpiece from jumping out, the guide ring pressing a part of the polishing cloth, which is located on the outer side of the workpiece; and a dress ring enclosing the guide ring and grinding the polishing cloth.

In each of the apparatuses, a guide ring may be provided along an outer edge of the lower face of the press plate, the guide ring may enclose the workpiece so as to prevent the workpiece from jumping out, and the guide ring may press a part of the polishing cloth, which is located on the outer side of the workpiece; and the press ring may include a dress ring enclosing the guide ring and grinding the polishing cloth.

In the present invention, by pressurizing the first, second and third fluid chambers, the workpiece can be pressed by three stages. By precisely adjusting pressure of each fluid chamber, the polishing pressure applied to the workpiece can be precisely controlled. Therefore, overpolishing an outer edge of the workpiece can be prevented, and the workpiece can be uniformly polished.

The pressure of the third fluid chamber is applied to an upper (rear) face of the workpiece via the backing pad or the elastic sheet member. Therefore, even if projections are formed on the rear face of the workpiece, the projections can be absorbed in the backing pad or the elastic sheet member, so that polishing the lower face of the workpiece is not badly influenced by the projections. Therefore, the workpiece can be uniformly polished.

By transmitting torque of the rotary shaft to the main head section and the press plate via the first transmitting member and the second transmitting member, twist of the first diaphragm and the second diaphragm can be prevented. Therefore, damaging the diaphragms can be prevented, so that frequency of exchanging diaphragms and maintenance cost can be reduced.

By correctly positioning the press plate with respect to the fixed base plate by fitting the center shaft, transverse vibrations of the press plate can be prevented so that the workpiece can be precisely polished.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
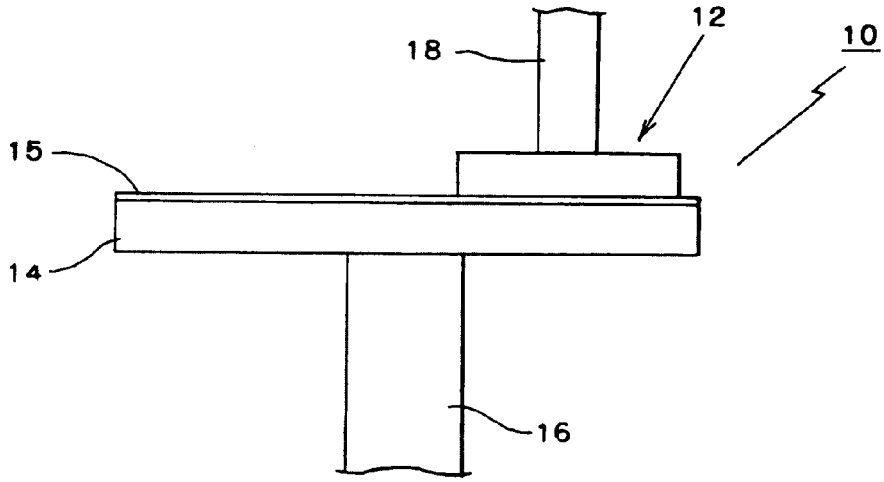
FIG. 1 is an explanation view of a polishing apparatus.
Figure 2:
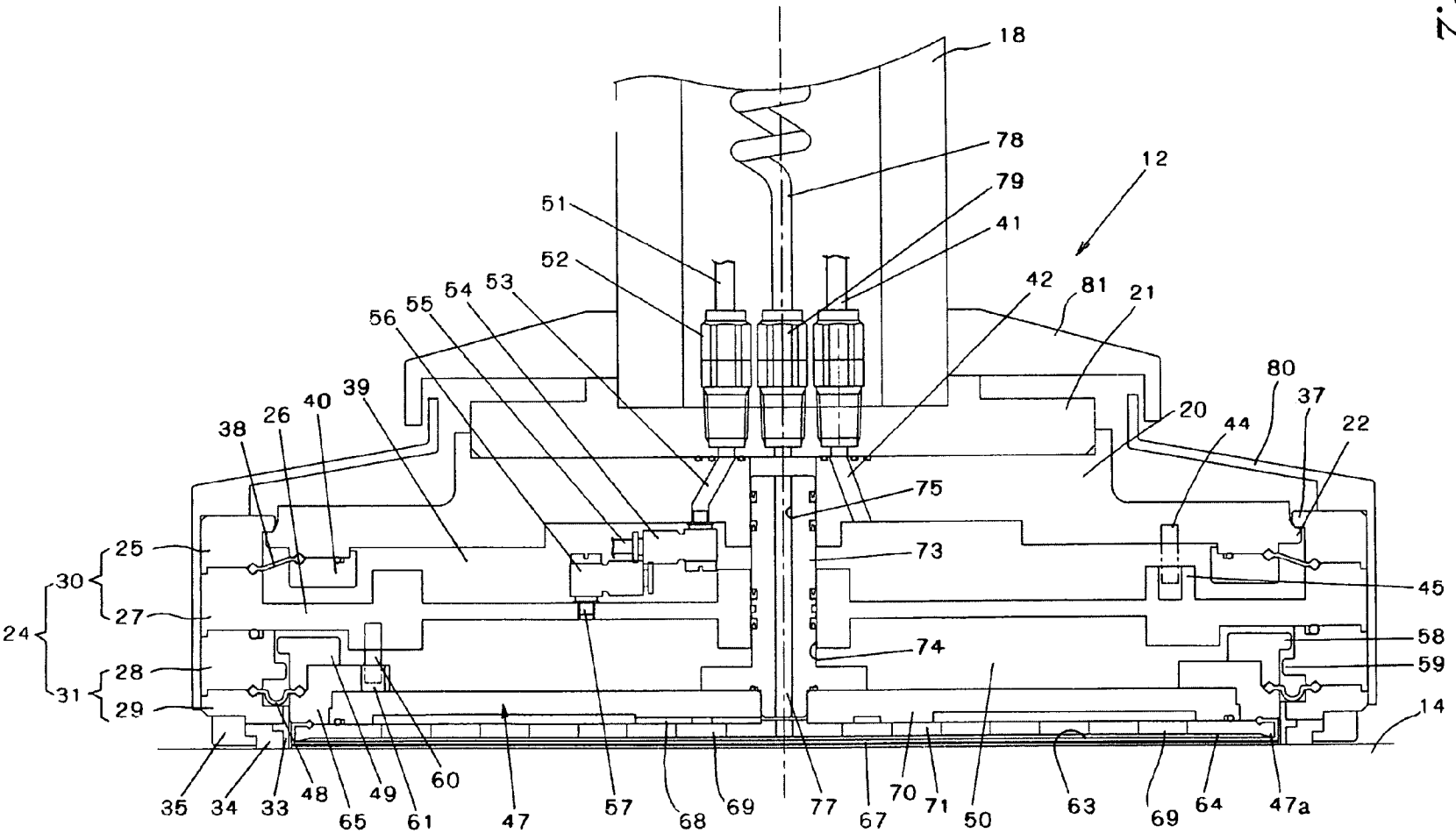
FIG. 2 is a sectional view of a holding head of a first embodiment.

FIG. 1 is an explanation view of a polishing apparatus 10 relating to the present invention, and FIG. 2 is a sectional view of a holding head 12 of a first embodiment.

In FIG. 1, a polishing cloth 15, which is nonwoven cloth made of, for example, polyurethane, is adhered on an upper face of a polishing plate 14 by, for example, an adhesive.

The polishing plate 14 is rotated, in a horizontal plane, with a spindle 16. The spindle 16 is rotated by a known driving mechanism (not shown).

The holding head 12 is attached to a lower end of a rotary shaft 18. The rotary shaft 18 is rotated about its axial line and moved upward and downward by a known mechanism (not shown). The holding head 12 is capable of moving between a position above the polishing plate 14 and another position outside of the polishing plate 14.

A lower face of a workpiece is polished by the steps of: holding the workpiece on the lower side of the holding head 12; moving the holding head 12 downward until the lower face of the workpiece contacts the polishing cloth 15; pressing the workpiece onto the polishing cloth 15 by a press mechanism; and rotating the polishing plate 14 and the holding head 12 in the horizontal plane.

Successively, the first embodiment of the holding head 12 will be explained with reference to FIG. 2.

A head base 20 is formed into a circular plate and fixed to a lower end of the rotary shaft 18 with an attachment 21. The rotary shaft 18 is a hollow shaft. An engaging projection (an engaging part) 22 is outwardly projected from a lower part of an outer circumferential face of the head base 20.

A main head section 24 has a layered cylindrical shape. The layers are constituted by: a first ring 25; a second ring 27, in which a partition (a bottom wall) 26 is provided in a lower part; a third ring 28; and a fourth ring 29.

An upper cylindrical part 30 is constituted by the first ring 25 and the second ring 27; a lower cylindrical part 31 is constituted by the third ring 28 and the fourth ring 29. Namely, the main head section 24 is vertically divided into the upper cylindrical part 30 and the lower cylindrical part 31 by the partition 26.

A guide ring 33 and a dress ring 34 are fixed on a bottom face of the fourth ring 29 by a holding ring 35. Namely, the guide ring 33 is located at an inmost position, the dress ring 34 is located on the outer side of the guide ring 33, a projected part of the guide ring 33 is pressed onto the fourth ring 29 by the dress ring 34, a projected part of the dress ring is pressed onto the fourth ring 29, and the holding ring 35 is fixed to the fourth ring 29 by screws (not shown). A press ring is constituted by the guide ring 33 and the dress ring 34.

The head base 20 enters the upper cylindrical part 30 so as to form an engaging projection (an engaging part) 37, which is inwardly projected from an upper part of an inner circumferential face of the first ring 25. The engaging projection 37 engages with the engaging projection 22 from outer and upper side. With this engagement, the main head section 24 is allowed to move toward the polishing plate 14 but the movement is limited, so that disengaging the main head section 24 can be prevented.

Preferably, an outer diameter of the engaging projection 22 is gradually increased toward a lower end, and an inner circumferential face of the engaging projection 37 corresponds to an outer circumferential face of the engaging projection 22. With this structure, the sloped outer circumferential face of the engaging projection 22 contacts the sloped inner circumferential face of the engaging projection 37 when the head base 20 is moved upward, so that the main head section 24 is correctly positioned with respect to the head base 20. By correctly positioning the main head section 24, the workpiece can be surely positioned at a predetermined position with respect to the holding head 12 when the holding head 12 is moved upward, so that the work can be surely transferred to the holding head 12. Further, for example, a first diaphragm 38 can be easily and correctly attached between the head base 20 and the main head section 24.

A space between the head base 20 and the upper cylindrical part 30 is air-tightly closed by the ring-shaped first diaphragm, so that a first fluid chamber 39 can be formed. An outer edge of the first diaphragm 38 is pinched by a lower face of the first ring 25 and an upper face of the second ring 27, so that the outer edge is fixed to the upper cylindrical part 30. On the other hand, an inner edge of the first diaphragm 38 is fixed to a lower face of the head base 20 by a holding member 40.

A pressurized fluid, e.g., compressed air, is introduced into the first fluid chamber 39 via a tube 41 in the rotary shaft 18 and a fluid path 42 in the head base 20 so as to press the main head section 24 downward, so that the guide ring 33 and the dress ring 34 can be pressed onto the polishing cloth 15. The tube 41 is connected to a pressure source (not shown) and introduces the pressurized fluid, whose pressure is adjusted by a regulator (not shown), into the first fluid chamber 39. First pressing means is constituted by the pressure source, the tube 41, the fluid path 42, etc.

A plurality of first transmitting pins 44, which act as first transmitting members, are projected downward from the lower face of the head base 20 and enter holes 45 formed in an upper face of the partition 26. With this structure, the main head section 24 is allowed to move, with respect to the head base 20, in the vertical direction only. Further, torque of the rotary shaft 18 or the head base 20 is transmitted to the main head section 24 by the first transmitting pins 44 and the holes 45. Note that, one of the first transmitting pins 44 and one of the holes 34 are shown in FIG. 2.

Since the torque of the rotary shaft 18 is transmitted by the first transmitting pins 44, means for transmitting the torque to the first diaphragm 38 is not required and toughness of the first diaphragm 38 is not required. Further, the first diaphragm 38 may be loosely attached between the head base 20 and the main head section 24.

Note that, the first transmitting pins 44 may be provided to the partition 26, and the holes 45 may be formed in the head base 20. Preferably, the first transmitting pins 44 and the partition 26 including the holes 45 are made of materials having small frictional resistances so as to smoothly slide each other.

A press plate 47 is provided in the lower cylindrical part 31 of the main head section 24, attached to the main head section 24 by a ring-shaped second diaphragm 48, and capable of moving toward the polishing plate 14. An outer edge of the second diaphragm 48 is pinched by a lower face of the third ring 28 and an upper face of the fourth ring 29; an inner edge thereof is fixed to an upper face of the press plate 47 by a holding member 49. With this structure, a second fluid chamber 50 is formed between the main head section 24 and the press plate 47.

The pressurized fluid, e.g., compressed air, is introduced into the second fluid chamber 50 via a tube 51 in the rotary shaft 18, a joint 52, a fluid path 53 in the head base 20, a joint 54, a tube 55 and a joint 56 in the first fluid chamber 39 so as to press the press plate 47 toward the polishing plate 14.

The tube 51 is connected to the pressure source (not shown) and introduces the pressurized fluid, whose pressure is adjusted by the regulator (not shown), into the second fluid chamber 50. Second pressing means is constituted by the pressure source, the tube 51, the fluid path 53, the joint 54, the tube 55, the joint 56, etc.

Note that, engaging projections 58 and 59 are respectively formed in the holding member 49 and the third ring 28. By engaging the engaging projections 58 and 59 each other, movement of the press plate 47 is limited, so that disengaging the press plate 47 can be prevented. Further, if engaging faces of the engaging projections 58 and 59 are formed into slope faces, the press plate 47 can be correctly positioned with respect to the main head section 24.

A plurality of second transmitting pins 60, which act as second transmitting members, are projected downward from the lower face of the partition 26 and enter holes 61 formed in an upper face of the press plate 47. With this structure, the press plate 47 is allowed to move, with respect to the main head section 24, in the vertical direction only. Further, torque of the main head section 24 is transmitted to the press plate 47 by the second transmitting pins 60 and the holes 61. Note that, one of the second transmitting pins 60 and one of the holes 61 are shown in FIG. 2.

Since the torque of the main head section 24 is transmitted to the press plate 47 by the second transmitting pins 60, means for transmitting the torque to the second diaphragm 48 is not required and toughness of the second diaphragm 48 is not required. Further, the second diaphragm 48 may be loosely attached between the main head section 24 and the press plate 47.

Note that, the second transmitting pins 60 may be provided to the press plate 47, and the holes 61 may be formed in the partition 26. Preferably, the second transmitting pins 60 and the press plate 47 including the holes 61 are made of materials having small frictional resistances so as to smoothly slide each other.

An elastic sheet member 63, which is made of, for example, rubber, is attached to the lower face of the press plate 47 so as to form a third fluid chamber 64 therebetween.

An outer edge of the press plate 47 is slightly projected downward to form a ring-shaped projection 47*a*. The lower face of the press plate 47 is completely covered with the elastic sheet member 63, so that the third fluid chamber 64 is enclosed by the ring-shaped projection 47*a* and air-tightly closed by the elastic sheet member 63. An outer edge of the elastic sheet member 63 is folded like a U-shape, and the folded part is pinched and fixed between the upper face of the press plate 47 and a holding member 65.

A backing pad 67 is adhered on a lower face of the elastic sheet member 63. The workpiece (not shown) is held on a lower face of the backing pad 67 by, for example, using surface tension of water. When the backing pad 67 holds the workpiece, the workpiece is accommodated in the guide ring 33 so as not to jump out therefrom.

A chamber 68 is formed in nearly whole of the press plate 47. The chamber 68 is communicated with the third fluid chamber 64 via a plurality of communication holes 69.

The chamber 68 can be easily constituted by, for example, the press plate 47, which is made by piling an upper plate 70 and a lower plate 71, and in which a concave part is formed in a lower face of the upper plate 70 or an upper face of the lower plate 71.

A center shaft 73 is vertically projected upward at a center of the press plate 47. The center shaft 73 is slidably pierced through shaft holes 74 and 75 of the partition 26 and the head base 20. With this structure, the press plate 47 can be correctly positioned and transverse vibrations of the press plate 47 can be effectively prevented.

An outer circumferential face of the center shaft 73 and an inner circumferential face of the shaft hole 75 is sealed by a seal ring.

A seal ring and a slide bearing are provided between the outer circumferential face of the center shaft 73 and an inner circumferential face of the shaft hole 74. Note that, if a suitable space is formed between the circumferential faces, a liner guide may be provided instead of the slide bearing. By using the linear guide, the press plate 47 can be more smoothly moved upward and downward.

A fluid path communicating with the third fluid chamber 64 is formed in the center shaft 73. The pressurized fluid, e.g., compressed air, is introduced into the third fluid chamber 64 via a tube 78 and a joint 79 in the rotary shaft 18, a fluid path 77, the chamber 68 and the communication holes 69, so that the workpiece, which is held on the lower face of the backing pad 67, can be pressed onto the polishing cloth 15 with the elastic sheet member 63 and the backing pad 67.

The tube 78 is connected to the pressure source (not shown) and introduces the pressurized fluid, whose pressure is adjusted by the regulator (not shown), into the third fluid chamber 64. Third pressing means is constituted by the pressure source, the tube 78, the fluid path 77, the chamber 68, the communication holes 69, etc.

Note that, the third pressing means discharges the fluid in the third fluid chamber 64 to produce negative pressure and sucks the elastic sheet member 63 so as to deform the elastic sheet member 63 like a sucking disk, so that the workpiece can be sucked and held on the lower face of the elastic sheet member 63.

By forming the chamber 68, the third fluid chamber 64 can be easily filled with the pressurized fluid, and the fluid in the third fluid chamber 64 can be easily discharged. Note that, the chamber 68 is not an essential element of the present invention.

Symbols 80 and 81 stand for covers. Next, the polishing action of the above described polishing apparatus 10 will be explained.

The workpiece has been adhered on the lower face of the backing pad 67 by surface tension of water. In this state, the holding head 12 is moved to a position above the polishing plate 14. Note that, the backing pad 67 is not an essential element. As described above, negative pressure is produced in the third fluid chamber 64 so as to deform the elastic sheet member 63 like the sucking disk, so that the workpiece is sucked and held on the lower face of the deformed sheet member 63 by the negative pressure. In this state, the holding head 12 is moved to the position above the polishing plate 14.

Next, the holding head 12 is moved downward by a known mechanism (not shown) until the workpiece contacts the polishing cloth 15.

Then, the pressurized fluid is introduced into the first fluid chamber 39, the second fluid chamber 50 and the third fluid chamber 64 so as to press the guide ring 33 and the dress ring 34 onto the polishing cloth 15 with prescribed pressing forces. The workpiece is pressed onto the polishing cloth 15, by the press plate 47 and the backing pad 67, with a prescribed pressing force. The polishing plate 14 and the holding head 12 are rotated in prescribed directions so as to polish the lower face of the workpiece. Slurry is supplied onto the polishing cloth 15 from a supply nozzle (not shown) while polishing the workpiece.

The first fluid chamber 39, the second fluid chamber 50 and the third fluid chamber 64 are independently pressurized by the first pressing means, the second pressing means and the third pressing means. Therefore, the workpiece can be pressed by three stages. By precisely adjusting inner pressure of each of the fluid chambers 39, 50 and 64, the pressing force applied to the workpiece can be precisely controlled so that the workpiece can be highly uniformly polished.

The pressure of the third fluid chamber 64 is applied to the upper (rear) face of the workpiece via the backing pad 67 and the elastic sheet member 63. Therefore, even if projections are formed on the rear face of the workpiece, the projections can be absorbed in the backing pad. 67 and the elastic sheet member 63 on the third fluid chamber 64 side, so that the polishing the lower face of the workpiece is not badly influenced by the projections. Therefore, the workpiece can be highly uniformly polished.

By transmitting torque of the rotary shaft 18 to the main head section 24 and the press plate 47 via the first transmitting pins 44, the second transmitting pins 60, etc., twist of the first diaphragm 38 and the second diaphragm 48 can be prevented. Therefore, damaging the diaphragms 38 and 48 can be prevented, so that frequency of exchanging diaphragms 38 and 48 and maintenance cost can be reduced.

Further, by correctly positioning the press plate 47 with respect to the fixed base plate 20 by fitting the center shaft 73, transverse vibrations of the press plate 47 can be prevented so that the workpiece can be precisely polished. The holding head 12 of a second embodiment will be explained with reference to FIG. 3.

The elements shown in FIG. 2 are assigned the same symbols, and explanation will be omitted.

In the second embodiment too, the workpiece W is pressed by three stages as well as the first embodiment.

In the first embodiment, the center shaft 73 is used for correctly positioning the press plate second embodiment, but the press plate 47 of the second embodiment has no center shaft. The features of the second embodiment are means for correctly positioning the press plate 47 and a mechanism for introducing the pressurized fluid into the third fluid chamber 64.

Firstly, the means for correctly positioning the press plate 47 will be explained. The first diaphragm 38 and the second diaphragm 48 are made of a material having enough toughness so as to correctly position the main head section 24 and the press plate 47. Note that, the diaphragms 38 and 48 allow the main head section 24 and the press plate 47 to move upward and downward. Further, the main head section 24 and the press plate 47 may be correctly positioned by the first transmitting pins 44 and the second transmitting pins 60. In this case, the toughness of the diaphragm 38 and 48 are not required.

The pressurized fluid is introduced into the third fluid chamber 64 via a tube 85 and a joint 86 in the rotary shaft 18, a fluid path 87 in the head base 20, a joint 88 and a tube 89 connected to the fluid path 87 and provided in the first fluid chamber 39, a joint 91 connected to a fluid path 90 of the partition 26, a joint 92 and a tube 93 connected to the fluid path 90 and provided in the second fluid chamber 50, a fluid path 94 of the press plate 47, a joint 95 connected to the fluid path 94, the chamber 68 and the communication holes 69.

In the second embodiment too, the workpiece W is pressed by three stages. By precisely adjusting inner pressure of each of the fluid chambers 39, 50 and 64, the pressing force applied to the workpiece W can be precisely controlled so that the workpiece W can be highly uniformly polished.

The torque of the rotary shaft 18 is transmitted to the main head section 24 and the press plate 47 by the first transmitting pins 44 and the second transmitting pins 60 as well as the first embodiment. If the diaphragms 38 and 48 have enough toughness, the torque of the rotary shaft 18 may be transmitted to the main head section 24 and the press plate 47 by the diaphragms 38 and 48. In this case too, the workpiece W can be pressed by three stages.

Figure 4:
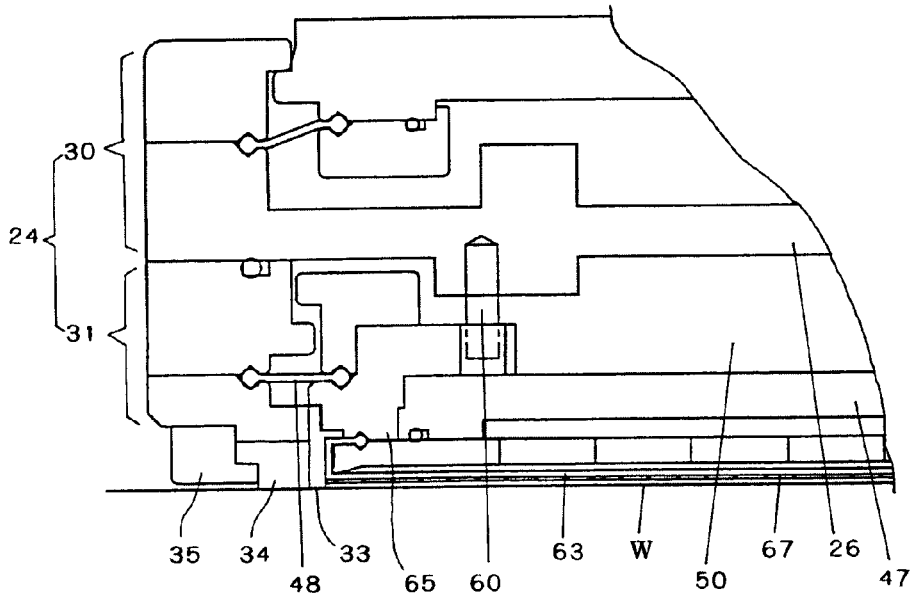
FIG. 4 is a partial sectional view of a guide ring provided on a press plate side.

In the first and the second embodiments, the guide ring 33 and the dress ring 34 are provided on the lower side of the main head section 24. The guide ring 33 may be provided to the press plate 47 as shown in FIG. 4. In FIG. 4, the guide ring 33 is fixed to the press plate 47 by the holding member 65, which fixes the elastic sheet member 63.

Note that, the guide ring 33 holds the workpiece W so as not to jump out and presses the polishing cloth 15 near an outer edge of the workpiece W. By pressing the polishing cloth 15 with the guide ring 33, the lower face of the workpiece W and the pressed part of the polishing cloth 15 located in the same plane, so that overpolishing the outer edge of the workpiece W can be prevented.

The dress ring 34 slightly grinds the surface of the polishing cloth 15 to fix up the surface condition. The dress ring 34 may be omitted.

Successively, the holding head 12 of a third embodiment will be explained.

Figure 3:
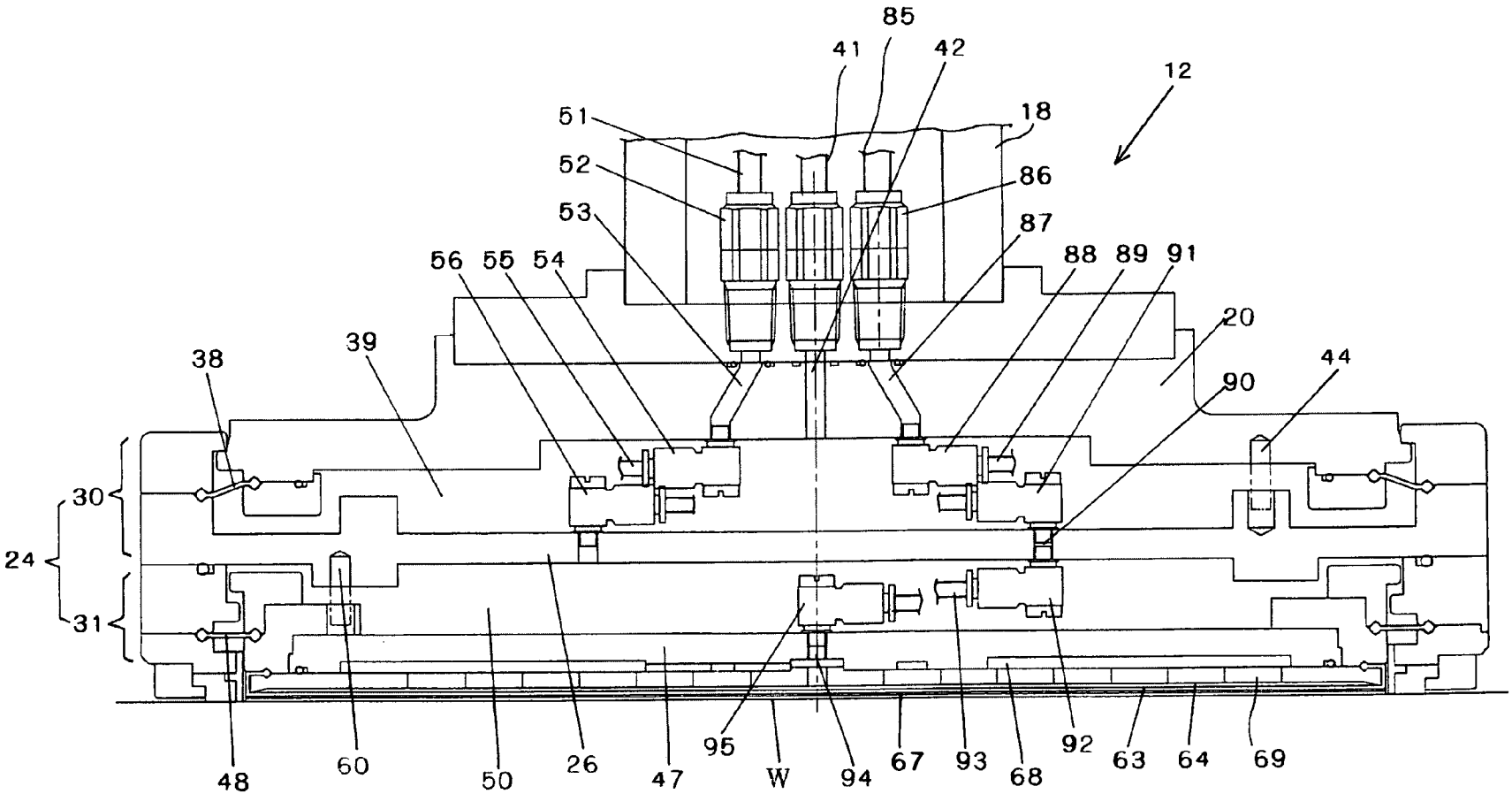
FIG. 3 is a sectional view of a holding head of a second embodiment.

The elements shown in FIGS. 2 and 3 are assigned the same symbols, and explanation will be omitted.

In the third embodiment too, the workpiece W is pressed by independent three stages as well as the first and the second embodiments.

In the third embodiment, no transmitting pins 44 and 60 of the foregoing embodiments are used. The torque of the rotary shaft 18 is transmitted to the main head section 24 and the press plate 47 by the first diaphragm 38 and the second diaphragm 48. Therefore, the diaphragms 38 and 48 have enough toughness.

Further, in the third embodiment, no elastic sheet member 63 of the foregoing embodiments is used.

Figure 5:
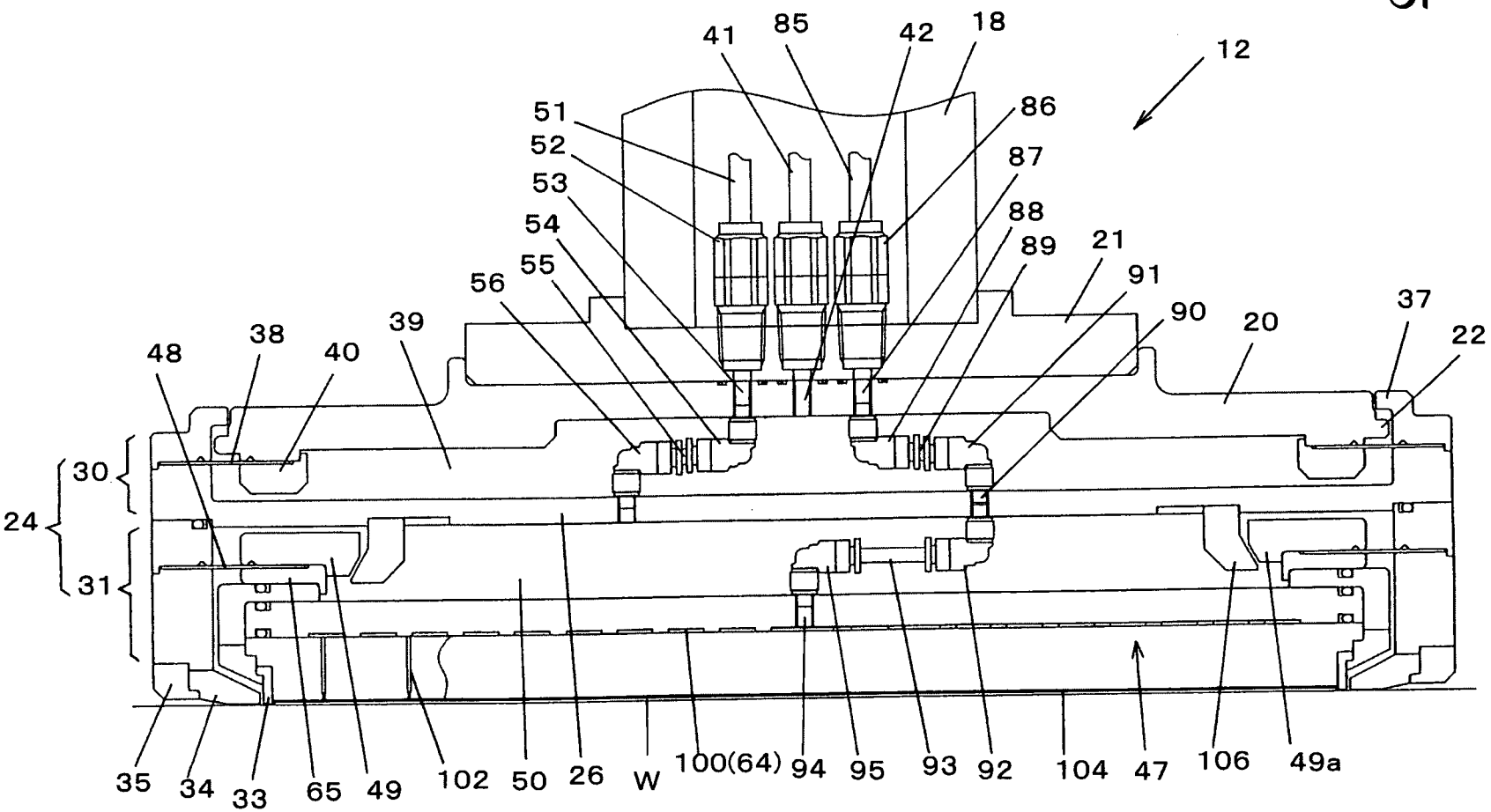
FIG. 5 is a sectional view of a holding head of a third embodiment.

In FIG. 5, chambers 100 are formed in the press plate 47, and the chambers 100 act as the third fluid chambers 64. The chambers 100 or the third fluid chambers 64 are formed as concentric ring grooves in nearly whole of the press plate 47. The concentric ring grooves are mutually communicated by communication grooves extended in the radial directions. The third pressing means is constituted by the tube 85, the joint 86, the fluid path 87, the joint 88, the tube 89, the joint 91 connected to the fluid path 90 of the partition 26, the joint 92 and the tube 93 connected to the fluid path 90 and provided in the second fluid chamber 50, the joint 95 connected to the fluid path 94 of the press plate 47 and the fluid path 94. The pressurized fluid is introduced into the chambers 100 by the third pressing means.

A plurality of small holes 102 are formed in the press plate 47. The small holes 102 are communicated with the chambers 100 and opened in the lower face of the press plate 47. The small holes 102 are uniformly distributed in the lower face of the press plate 47.

The workpiece W is held on the lower face of the press plate 47 and polished. Note that, a backing pad 104 having a plurality of fine holes may be attached to the lower face of the press plate 47, and the workpiece W may be held on a lower face of the backing pad 104.

The holding member 49 for fixing the second diaphragm 48 has an engaging projection 49*a*, which is inwardly projected and which has a slope face. On the other hand, an engaging ring 106 having a slope face is provided on the lower face of the partition 26. By contacting the slope faces each other, the main head section 24 and the press plate 47 can be correctly positioned.

By introducing the pressurized fluid into the chambers 100 or the third fluid chambers 64 by the third pressing means, the fluid can be jetted out from the lower face of the press plate 47 via the small holes 102. Therefore, the workpiece W is pressed by pressure of the jetted fluid. In the third embodiment too, the workpiece W can be pressed by three stages, so the workpiece W can be highly uniformly polished. Note that, the guide ring 33 is located as close to the outer edge of the workpiece W as possible, so that leakage of the pressurized fluid can be prevented.

When the holding head 12 is moved before and after polishing the workpiece W, the fluid in the chambers 100 or the third fluid chambers 64 is discharged by the third pressing means so as to suck and hold the workpiece W on the lower face of the press plate 47.

The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A polishing apparatus, comprising:

a polishing plate having an upper face, on which a polishing cloth is adhered;

a holding head having a lower face, on which a workpiece is held so as to press the workpiece onto the polishing cloth; and a driving mechanism for relatively moving said polishing plate with respect to said holding head so as to polish a lower face of the workpiece, wherein said holding head comprises:

a head base;

a main head section being attached on the lower side of the head base with a first diaphragm and capable of moving toward said polishing plate, said main head section having a press ring, which is provided on the lower side thereof and capable of pressing the polishing cloth;

a press plate being provided in the main head section with a second diaphragm and capable of moving toward said polishing plate;

the press plate including a lower plate portion;

an elastic sheet member being attached to an outer radial surface of the lower plate portion of the press plate;

a first fluid chamber being formed between the head base and the main head section and closed by the first diaphragm;

a second fluid chamber being formed between the main head section and the press plate and closed by the second diaphragm;

a third fluid chamber being formed between the lower face of the press plate and the elastic sheet member;

first pressing means for introducing a pressurized fluid into the first fluid chamber and pressing the main head section downward;

second pressing means for introducing a pressurized fluid into the second fluid chamber and pressing the press plate downward; and third pressing means for introducing a pressurized fluid into the third fluid chamber and pressing the workpiece downward, and whereby the workpiece is held on the lower side of the elastic sheet member, and the lower face of the workpiece can be polished.

2. The polishing apparatus according to claim 1, wherein the third pressing means discharges the fluid in the third fluid chamber so as to give a sucking function to the elastic sheet member so that the elastic sheet member is capable of sucking and holding the workpiece.

3. The polishing apparatus according to claim 1.

wherein a backing pad is adhered on a lower face of the elastic sheet member, and the workpiece is held on the lower side of the backing pad.

4. The polishing apparatus according to claim 1, wherein:

the main head section has a cylindrical shape and is vertically divided into an upper cylindrical part and a lower cylindrical part by a cylindrical partition member, the upper cylindrical part, the lower cylindrical part and the partition member having a common outer radius that is the outermost radius of the main head section;

the first fluid chamber is constituted by the head base entering the upper cylindrical part and the first diaphragm closing a space between the head base and the upper cylindrical part, and the second fluid chamber is constituted by the press ring attached to the lower cylindrical part, the press plate provided in the lower cylindrical part and the second diaphragm closing a space between the lower cylindrical part and the press plate.

5. The polishing apparatus according to claim 1, wherein a rotary shaft is connected to the head base, the head base is rotated by rotating the rotary shaft, the main head section is rotated with the first diaphragm, and the press plate is rotated with the second diaphragm.

6. The polishing apparatus according to claim 1, wherein a rotary shaft is connected to the head base, the head base and the main head section are engaged by a first transmitting member so as to allow the main head section to move upward and downward, the main bead section and the press plate are engaged by a second transmitting member so as to allow the press plate to move upward and downward, the head base is rotated by rotating the rotary shaft, the main head section is rotated with the first transmitting member, and the press plate is rotated with the second transmitting member.

7. The polishing apparatus according to claim 6, wherein the first transmitting member and the second transmitting member are pins.

8. The polishing apparatus according to claim 4, wherein a center shaft is vertically extended from a center of the press plate, and the center shaft is capable of fitting with a shaft hale of the head base, so that the press plate can be correctly positioned and transverse vibrations of the press plate can be prevented.

9. The polishing apparatus according to claim 8, wherein a fluid path communicating with the third fluid chamber is formed in the center shaft, and a pressurized fluid is introduced into the third fluid chamber via the fluid path.

10. The polishing apparatus according to claim 1, wherein the bead base and the main head section respectively have engaging parts, which engage each other when the head base is moved upward, and the engaging parts are slope faces, which are capable of correctly positioning the main head section with respect to the head base.

11. The polishing apparatus according to claim 1, wherein the main head section and the press plate respectively have engaging parts, which engage each other when the head base is moved upward, and the engaging parts are slope faces, which are capable of correctly positioning the press plate with respect to the main head section.

12. The polishing apparatus according to claim 1, wherein the press ring includes:

a guide ring enclosing the workpiece so as to prevent the workpiece from jumping out, the guide ring pressing a part of the polishing cloth, which is located on the outer side of the workpiece; and a dress ring enclosing the guide ring and grinding the polishing cloth.

13. The polishing apparatus according to claim 1, wherein a guide ring is provided along an outer edge of the lower face of the press plate, the guide ring encloses the workpiece so as to prevent the workpiece from jumping out, and the guide ring presses a part of the polishing cloth, which is located on the outer side of the workpiece; and the press ring includes a dress ring enclosing the guide ring and grinding the polishing cloth.

14. A polishing apparatus, comprising:

a polishing plate having an upper face, on which a polishing cloth is adhered;

a holding head having a lower face, on which a workpiece is held so as to press the workpiece onto the polishing cloth; and a driving mechanism for relatively moving said polishing plate with respect to said holding head so as to polish a lower face of the workpiece, wherein said holding head comprises:

a head base;

a main head section being attached on the lower side of the head base with a first diaphragm and capable of moving toward said polishing plate, said main head section having a press ring, which is provided on the lower side thereof and capable of pressing the polishing cloth;

a press plate being provided in the main head section with a second diaphragm and capable of moving toward said polishing place;

an elastic sheet member being attached on a lower face of the press plate;

a first fluid chamber being formed between the head base and the main head section and closed by the first diaphragm;

a second fluid chamber being formed between the main head section and the press plate and closed by the second diaphragm;

a third fluid chamber being formed between the lower face of the press plate and the elastic sheet member;

first pressing means for introducing a pressurized fluid into the first fluid chamber and pressing the main head section downward;

second pressing means for introducing a pressurized fluid into the second fluid chamber and pressing the press plate downward; and third pressing means for introducing a pressurized fluid into the third fluid chamber and pressing the workpiece downward, and whereby the workpiece is held on the lower side of the elastic sheet member, and the lower face of the workpiece can be polished;

wherein:

a rotary shaft is connected to the head base, the head base and the main head section are engaged by a first transmitting member so as to allow the main head section to move upward and downward, the main head section and the press plate are engaged by a second transmitting member so as to allow the press plate to move upward and downward, the head base is rotated by rotating the rotary shaft, the main head section is rotated with the first transmitting member, and the press plate is rotated with the second transmitting member.

15. A polishing apparatus, comprising:

a polishing plate having an upper face, on which a polishing cloth is adhered;

a holding head having a lower face, on which a workpiece is held so as to press the workpiece onto the polishing cloth; and a driving mechanism for relatively moving said polishing plate with respect to said holding head so as to polish a lower face of the workpiece, wherein said holding head comprises:

a head base;

a main head section being attached on the lower side of the head base with a first diaphragm and capable of moving toward said polishing plate, said main bead section having a press ring, which is provided on the lower side thereof and capable of pressing the polishing cloth;

a press plate being provided in the main head section with a second diaphragm and capable of moving toward said polishing plate;

an elastic sheet member being attached on a lower face of the press place;

a first fluid chamber being formed between the head base and the main head section and closed by the first diaphragm;

a second fluid chamber being formed between the main head section and the press plate and closed by the second diaphragm;

a third fluid chamber being formed between the lower face of the press plate and the elastic sheet member;

first pressing means for introducing a pressurized fluid into the first fluid chamber and pressing the main head section downward;

second pressing means for introducing a pressurized fluid into the second fluid chamber and pressing the press plate downward; and third pressing means for introducing a pressurized fluid into the third fluid chamber and pressing the workpiece downward, and whereby the workpiece is held on the lower side of the elastic sheet member, and the lower face of the workpiece can be polished;

wherein:

the head base and the main head section respectively have engaging parts, which engage each other when the bead base is moved upward and disengage each other when the head base is moved downward, and the engaging parts are slope faces, which are capable of correctly positioning the main head section with respect to the head base.

16. A polishing apparatus, comprising:

a polishing plate having an upper face, on which a polishing cloth is adhered;

a holding head having a lower face, on which a workpiece is held so as to press the workpiece onto the polishing cloth; and a driving mechanism for relatively moving said polishing plate with respect to said holding head so as to polish a lower face of the workpiece, wherein said holding head comprises:

a head base;

a main head section being attached on the lower side of the head base with a first diaphragm and capable of moving toward said polishing plate, said main head section having a press dug, which is provided on the lower side thereof and capable of pressing the polishing cloth;

a press plate being provided in the main head section with a second diaphragm and capable of moving toward said polishing plate;

an elastic sheet member being attached on a lower face of the press plate;

a first fluid chamber being formed between the head base and the main head section and closed by the first diaphragm;

a second fluid chamber being formed between the main head section and the press plate and closed by the second diaphragm;

a third fluid chamber being formed between the lower face of the press plate and the elastic sheet member;

first pressing means for introducing a pressurized fluid into the first fluid chamber and pressing the main head section downward;

second pressing means for introducing a pressurized fluid into the second fluid chamber and pressing the press plate downward; and third pressing means for introducing a pressurized fluid into the third fluid chamber and pressing the workpiece downward, and whereby the workpiece is held on the lower side of the elastic sheet member, and the lower face of the workpiece can be polished;

wherein;

the main head section and the press plate respectively have engaging parts, which engage each other when the press plate is axially moved in a first direction relative to the main head section and which disengage each other when the press plate is axially moved in a second direction that opposes the first direction, and the engaging parts are slope faces, which are capable of correctly positioning the press plate with respect to the main head section.

* * * * *

UNITED STATES PATENT AND TRADEMARK OFFICE

CERTIFICATE OF CORRECTION

PATENT NO. : 7,247,083 B2
APPLICATION NO. : 11/088191
DATED : July 24, 2007
INVENTOR(S) : Tadakazu Miyashita et al.

It is certified that error appears in the above-identified patent and that said Letters Patent is hereby corrected as shown below:

In Column 12, line 51, claim 8 please change “hale” to -- hole --.

In Column 13, line 45, claim 14 please change “place” to -- plate --.

In Column 14, line 37, claim 15 please change “place” to -- plate --.

Signed and Sealed this

Seventeenth Day of June, 2008

JON W. DUDAS
*Director of the United States Patent and Trademark Office*